US005665005A

United States Patent [19]

Ritchie

[11] Patent Number: 5,665,005

[45] Date of Patent: Sep. 9, 1997

[54] SPORT SWING TRAINING DEVICE

[76] Inventor: Gregory A. Ritchie, 137 Hemlock Forest, Mineral, Va. 23117

[21] Appl. No.: 705,748

[22] Filed: Aug. 30, 1996

[51] Int. Cl.[6] ..... A63B 69/36; A63B 69/00

[52] U.S. Cl. ..... 473/216; 473/215; 473/269; 473/271; 473/272; 473/273; 473/277; 473/451; 473/452; 473/458

[58] Field of Search ..... 473/215, 216, 473/269, 271, 272, 273, 277, 451, 452, 458

[56] References Cited

U.S. PATENT DOCUMENTS

| | | | |
|---|---|---|---|
| 3,414,268 | 12/1968 | Chase . | |
| 4,830,371 | 5/1989 | Lay . | |
| 4,993,708 | 2/1991 | Prosser et al. . | |
| 5,100,134 | 3/1992 | Becker . | |
| 5,125,663 | 6/1992 | Lurowist, Jr. . | |
| 5,470,055 | 11/1995 | Ritchie | 473/215 |

*Primary Examiner*—George J. Marlo
*Attorney, Agent, or Firm*—Fish & Richardson P.C.

[57] ABSTRACT

A sport swing training device has a base assembly, a height adjustable stanchion having a first end and a second end, wherein the first end of the stanchion is attachable to the base assembly. The stanchion further includes a spring to permit tipping of the stanchion when the stanchion is attached to the base assembly, and an adjustable seat secured to the second end of the stanchion. A restraining clutch is attachable to the base assembly such that when attached, the restraining clutch limits the range of tipping of the stanchion during a pre-swing stage and, a swing stage for hitting a ball. The device also includes an adjustable seat plate to which the seat is connected and at least one adjustable extension having opened and locked positions for controlling the range of rotational movement of the seat plate. A stance and stride guiding extension is provided for attachment to the base assembly to accommodate the width of a hitter's stance or the direction and length of a hitter's stride when the hitter is executing the pre-swing stage and the swing stage.

37 Claims, 9 Drawing Sheets

SPORT SWING TRAINING DEVICE

BACKGROUND OF THE INVENTION

The invention relates generally to sporting instruction equipment, and more specifically, to a hitter's training device, for use in swing reliant sports such as golf.

U.S. Pat. No. 5,470,055, which issued to the applicant of the present invention and which is incorporated by reference herein, discloses a baseball and golf hitter's training device that creates a better balance to help a hitter perform a proper weight shift during execution of a pre-swing stage and a swing stage for hitting a baseball and golf ball, respectively. The present invention is directed to improvements with respect to those and similar training devices.

SUMMARY OF THE INVENTION

In general, in one aspect, the invention features a sport swing training device having a base assembly and a height adjustable stanchion including a first end and a second end, wherein the first end of the stanchion is attachable to the base assembly. The stanchion further includes a spring to permit tipping of the stanchion when the stanchion is attached to the base assembly. The training device also has an adjustable seat secured to the second end of the stanchion and a restraining clutch attachable to the base assembly such that, when attached, the restraining clutch limits the range of tipping of the stanchion during a pre-swing stage and a swing stage for hitting a ball.

In another aspect, the invention features a sport swing training device including a base assembly and a height adjustable stanchion having a first end and a second end, wherein the first end of the stanchion is attachable to the base assembly. The training device also includes an adjustable seat plate and an adjustable seat for connection to the second end of the stanchion wherein the seat is secured to the stanchion by the seat plate. In addition, the training device includes at least one adjustable extension having opened and locked positions for controlling the range of rotational movement of the seat plate.

In yet a further aspect, the invention features a sport swing training device having a base assembly including a tri-foot radial configuration having two rearwardly extending feet and a short forwardly extending foot. The training device also includes a height adjustable stanchion having a first end and a second end, wherein the first end of the stanchion is attachable to the base assembly. An adjustable seat is secured to the second end of the stanchion. The training device also includes a foot guiding extension for attachment to the base assembly to assist a hitter during execution of a pre-swing stage and a swing stage for hitting a ball.

Methods of using the training device are also disclosed.

The invention can assist a hitter, such as golfer, to improve his or her swing. In particular, in various implementations of the invention, the swing training device of the invention can improve the hitter's balance, posture, stance or stride during a pre-swing stage and/or a swing stage for hitting a ball.

Additional features and advantages of the invention will be readily apparent from the detailed description and accompanying drawings and claims.

BRIEF DESCRIPTION OF THE DRAWINGS

A brief description of the drawings, which are not drawn to scale, is as follows.

DESCRIPTION OF THE PREFERRED EMBODIMENTS

Figure 1:
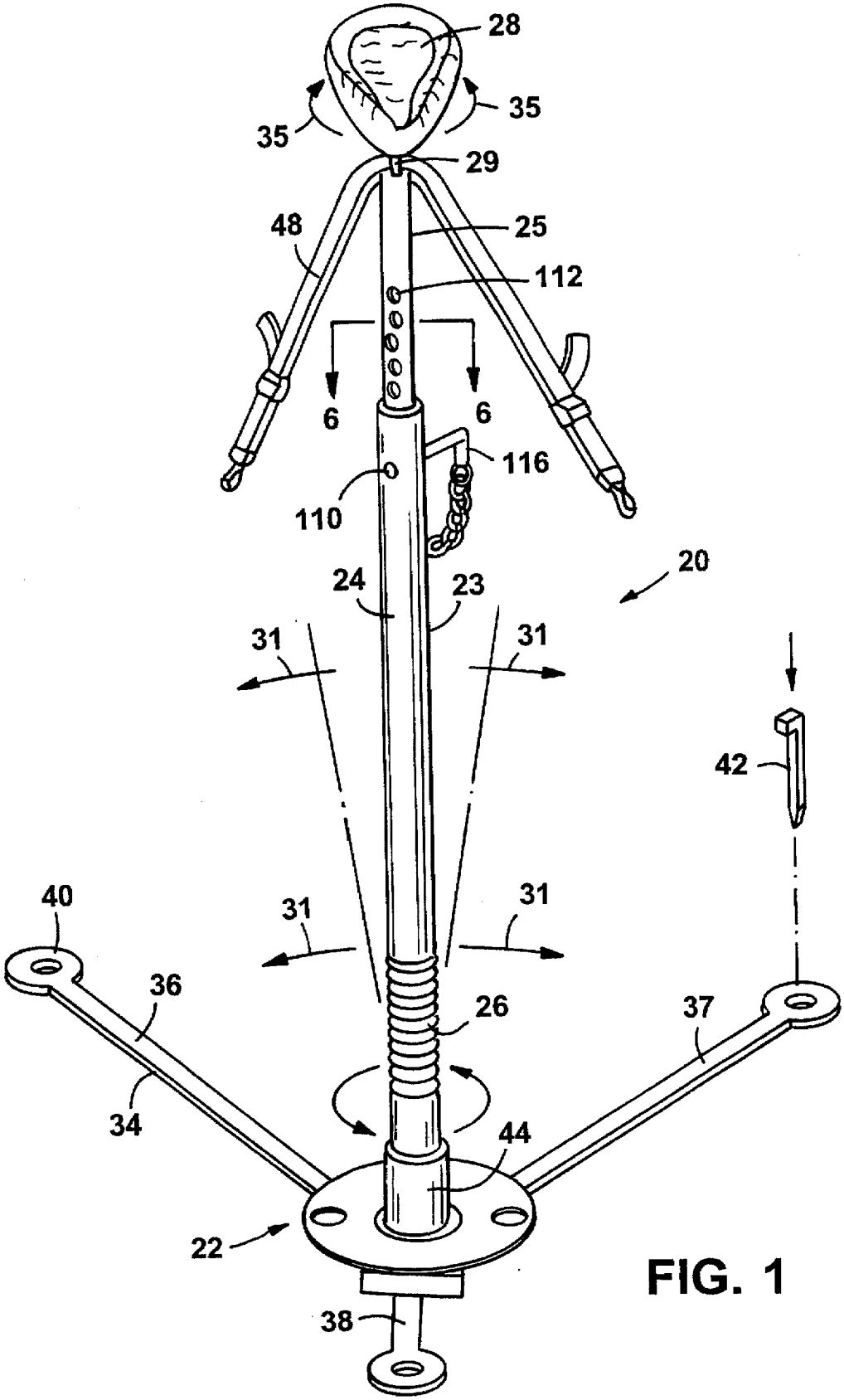
FIG. 1 is a front perspective view of a portion of the training device of the invention.
Figure 2:
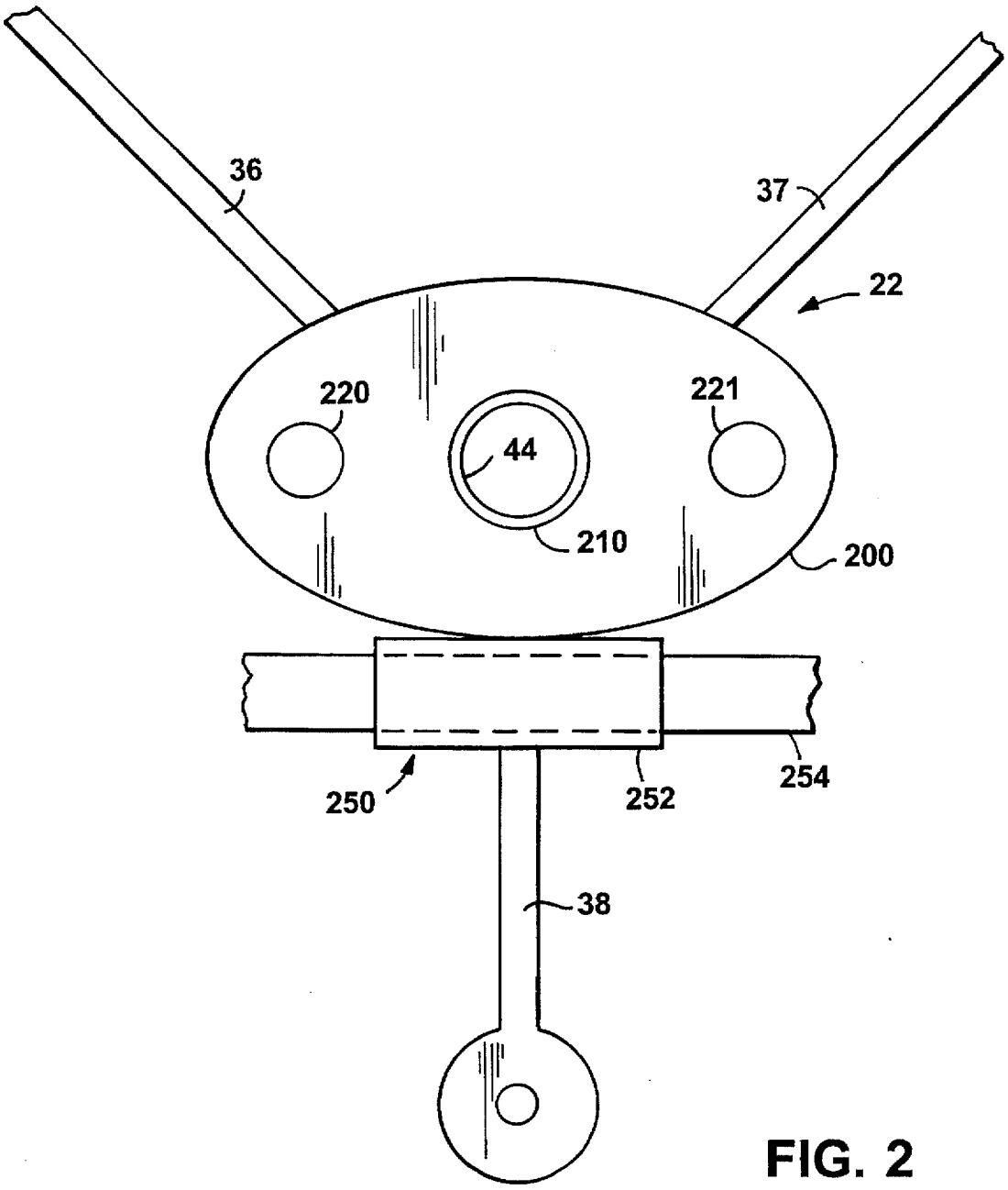
FIG. 2 is a cross-sectional view taken on line 6—6 in FIG. 1.

FIGS. 1–2 illustrate a golf hitter's training device 20 which includes a base assembly 22 and a height adjustable stanchion 24 attached to the base assembly 22. The stanchion 24 includes a tube portion 23 with a hole 110 and a shaft portion 25 with multiple holes 112 spaced vertically along the shaft portion 25. The stanchion 24 can be retained at a desired height by adjusting the shaft portion 25 upward or downward with respect to the tube portion 23 and by inserting a pin 116 through the hole 110 and one of the holes 112. The stanchion 24 further includes a spring 26 which is attached between the ends of the stanchion 24 and which permits the stanchion to tip or flex as indicated by arrows 31. In addition, the training device 20 includes an adjustable seat 28 for steadying a hitter astride the stanchion 24 to help the hitter perform a proper weight shift during execution, for example, of a pre-swing stage and swing stage of hitting a golf ball with a golf club. The seat can be secured to the stanchion 24 with a ball joint (not shown) which permits the seat to adjust automatically to the user's movement in the direction of arrows 35, but substantially forces the user to maintain a proper stance. An adjustable strap 48 can be coupled to the seat 28 through one or more metal rings 29 welded to the underside of the seat, for securement about the thighs of the hitter, to maintain the hitter upon the seat.

In certain implementations, the base assembly 22 includes a tri-foot radial configuration 34 having two rearwardly extending feet 36, 37 and a short forwardly extending foot 38. A collar 44 extends upward from the center of the tri-foot radial configuration 34 to receive the bottom end of the stanchion 24. The bottom end of the stanchion 24 and the inner surface of the collar 44 are threaded so that the stanchion 24 can be screwed to the base assembly 22. In addition, each foot 36–38 of the base assembly 22 has an eyelet shaped end 40 to receive a spike 42 to hold the feet 36–38 securely in the ground.

As shown in FIG. 2, an oval-shaped base plate 200 is welded to the center of the tri-foot radial configuration 34. The base plate 200, which can be several inches in diameter, includes an opening 210 in its center through which the collar 44 of the base assembly 22 extends. The base plate 200 further includes at least one additional opening, spaced from the opening 210, for receiving a restraining clutch as discussed more fully below. The implementation shown in FIG. 2 includes two such openings in the form of bushings 220, 221 extending through the base plate 200 and located on opposite sides of the opening 210.

A foot guide 250 is provided along one side of the base plate 200 adjacent the short foot 38 of the base assembly 22. The foot guide 250 is formed of a hollow bushing or metal sleeve 252 welded to the base plate 200 and a plastic rod 254 which can be removably inserted into the bushing 252. The foot guide 250 can be used by a golfer to align his or her feet to achieve a proper stance.

The training device 20 can also include a structure which can be mounted on the base assembly 22 to hold a golf tee and a golf ball in place so that the golfer can hit the ball. A suitable structure is disclosed in the aforementioned U.S. Pat. No. 5,470,055 and can be mounted on either side of the base assembly 22 to accommodate both right-handed and left-handed hitters.

Figure 4:
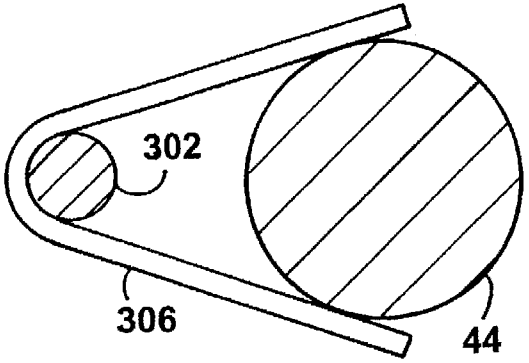
FIG. 4 is a cross-sectional view taken on line 8—8 in FIGS. 3A and 3B.
Figure 3B:
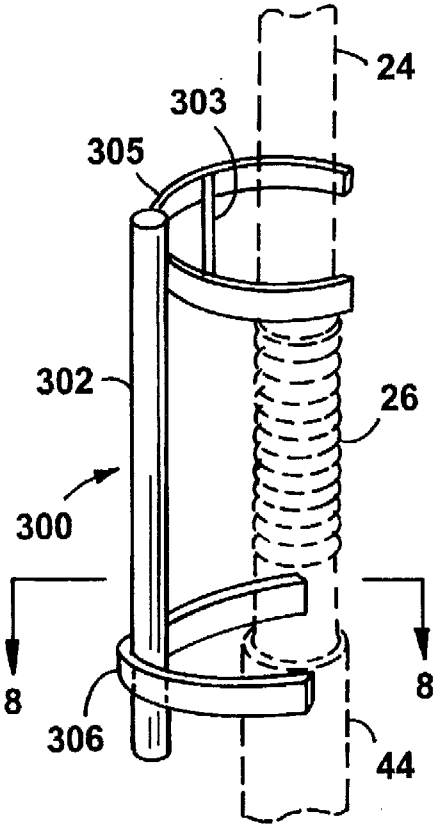
FIGS. 3A and 3B are elevational views of various implementations of a restraining clutch according to the invention.
Figure 3A:
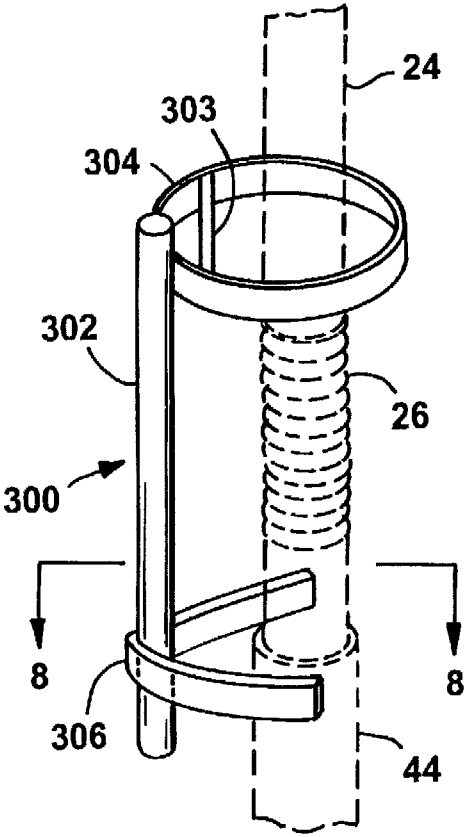
Figure 5:
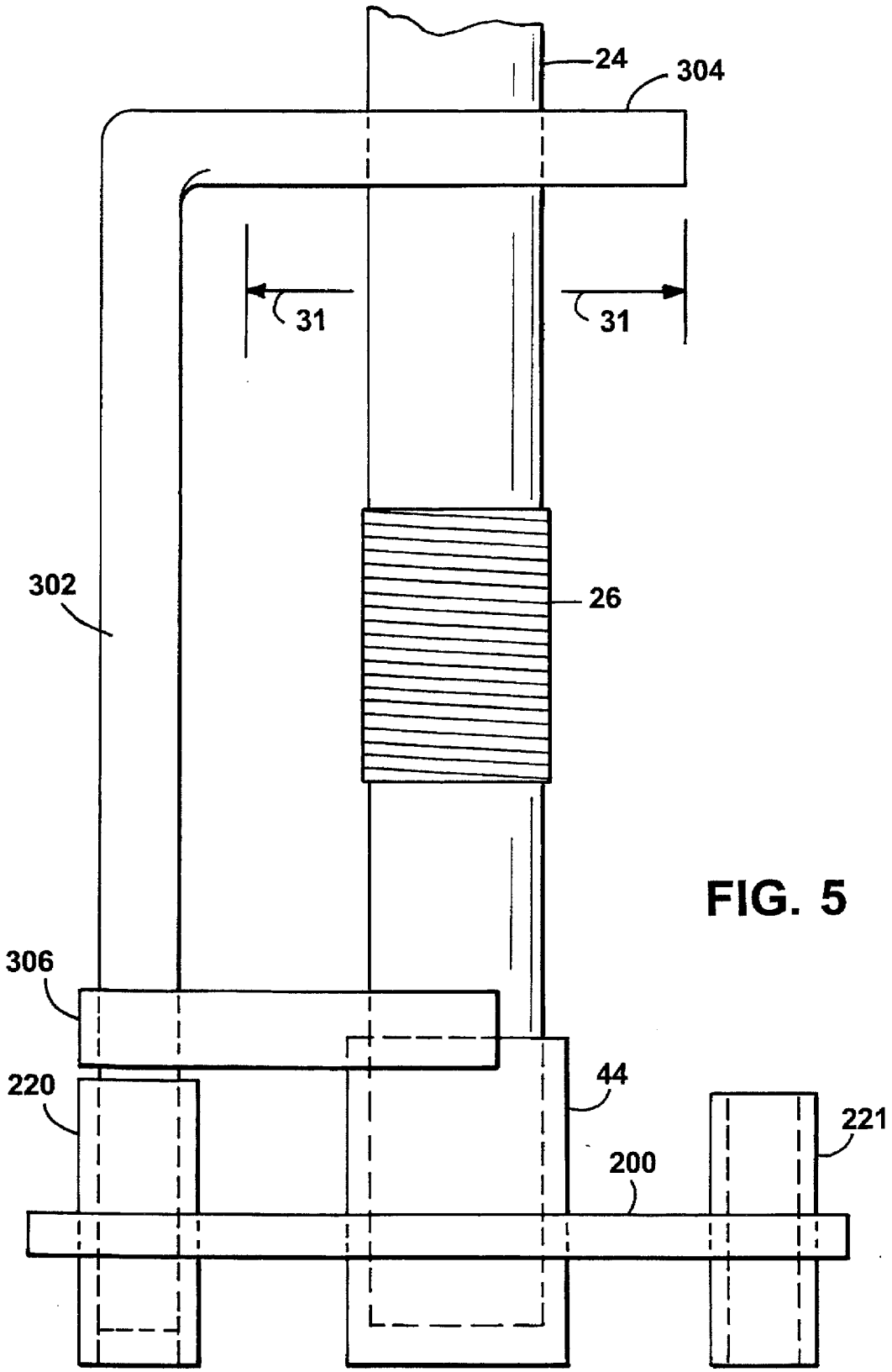
FIG. 5 is a cross-sectional side view of a restraining clutch inserted into a base assembly according to the invention.

As illustrated in FIGS. 3A–3B, the training device 20 further includes a restraining clutch 300 which can be removably inserted into one of the bushings 220, 221 as explained more fully below. As shown in the implementation of FIG. 3A, the restraining clutch 300 includes a shaft 302 and a circular or oval-shaped closed ring 304 welded to the upper end of the shaft 302. Alternatively, the restraining clutch 300 can include a U-shaped open ring 305 welded to the upper end of the shaft 302, as shown in FIG. 3B. A V-shaped position fixing element 306 is welded toward the bottom end of the restraining clutch 300. When the restraining clutch 300 is properly inserted into one of the bushings 220, 221 of the base plate 200, the V-shaped position fixing element 306 contacts the upper portion of the outer surface of the collar 44 of the base assembly 22 as shown in FIGS. 4–5. This configuration substantially prevents the restraining clutch 300 from rotating within the bushing 220 or 221 and helps secure the restraining clutch 300 in a substantially fixed position relative to the base assembly 22.

The ring 304 or 305 of the restraining clutch 300 is designed to limit the amount of flexing or tipping of the stanchion 24 when a hitter is using the training device. Thus, the size and precise contour of the ring 304 or 305 are selected according to the desired limits on the amount and direction of flexing. Similarly, certain implementations include a metal bar 303 attached to the ring 304 or 305 so that the bar 303 intersects the perimeter of the ring at two points to further limit the range of tipping during execution of a pre-swing stage and swing stage.

Figure 6:
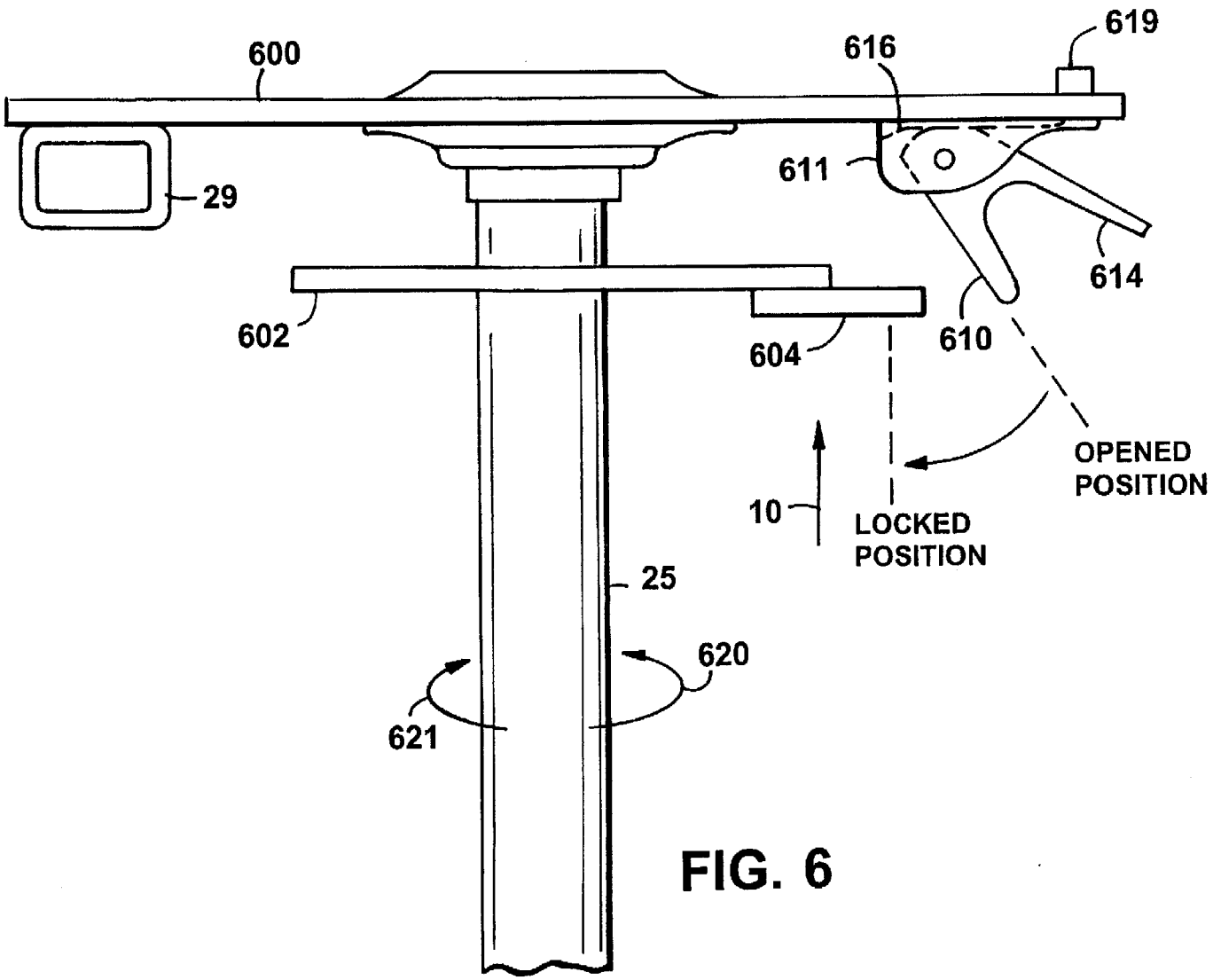
FIG. 6 is a side view of a seat plate according to the invention.
Figure 7:
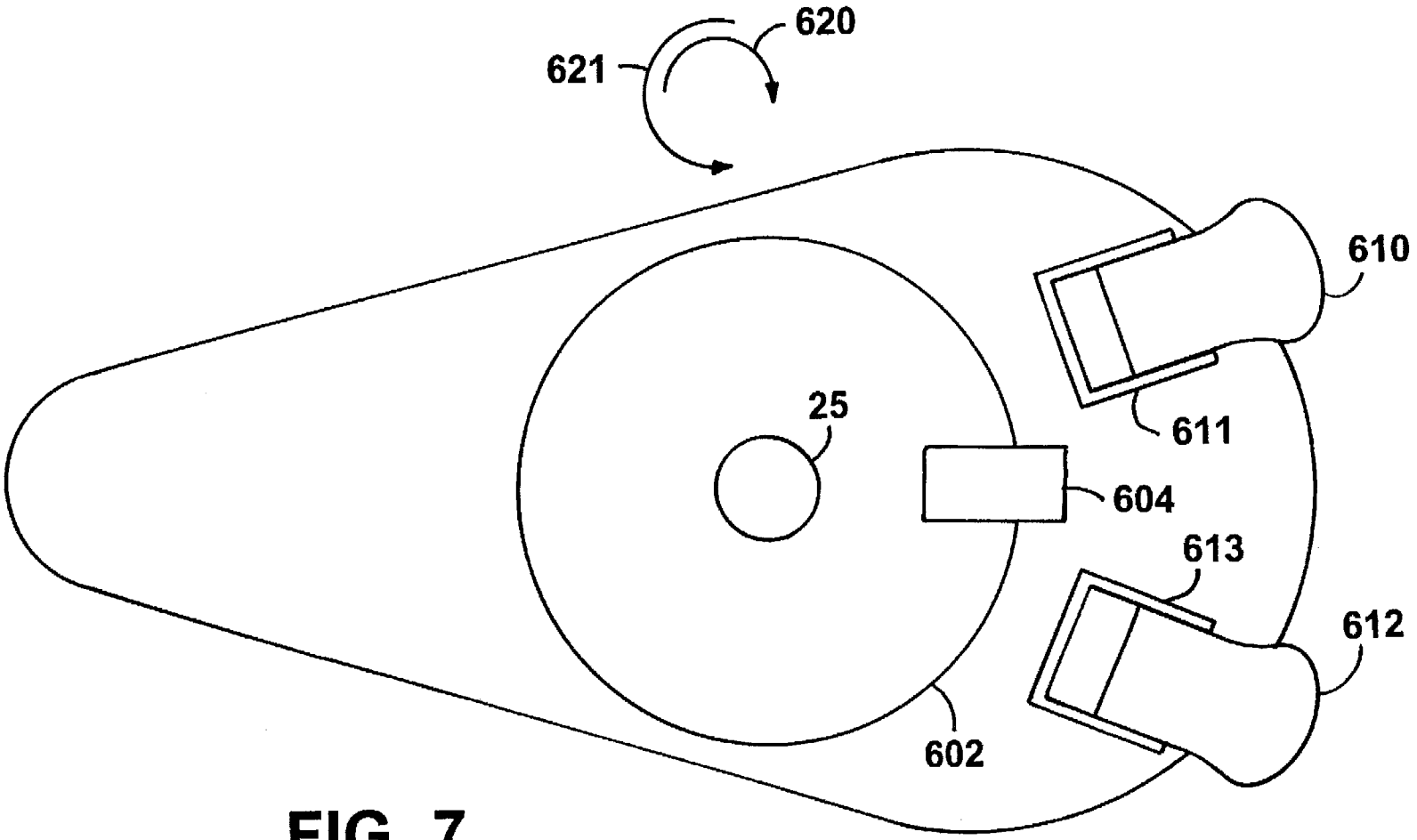
FIG. 7 is a view of the seat plate in the direction of arrow 10 in FIG. 6.

FIGS. 6–7 illustrates further details of the upper end of the stanchion 24 and a seat plate 600 to which the seat 28 is secured. A circular washer 602 is welded to the shaft portion 25 of the stanchion 24 above the holes 112 in the shaft portion 25. A small metal stop tab or extension 604 is welded to the underside of the washer 602 in a fixed position. Steel brackets 611, 613 are provided on the underside of the seat plate 600, and brass stop tabs or extensions 610, 612 are adjustably attached to the brackets 611, 613, respectively. Each of the adjustable stop tabs 610, 612 can be rotated into either opened or locked positions to adjust the range of rotational movement of the seat plate 600 in either or both of the directions shown by arrows 620, 621. When both adjustable stop tabs 610, 612 are in their opened positions, the seat plate 600 can rotate completely about the major axis of the stanchion 24. The adjustable stop tabs 610, 612 are preferably located such that when both adjustable stop tabs 610, 612 are in their locked positions, the position of the seat plate 600 is substantially fixed with respect to the axis of the stanchion 24, thereby substantially preventing rotational movement of the seat plate in the direction of the arrows 620, 621. Either one of the adjustable stop tabs 610, 612 can be in its locked position while the second adjustable stop tab is in its opened position, thereby limiting the range of rotational movement of the seat plate 600 in one of the directions 620 or 621, respectively. For example, if only the stop tab 610 is in its locked position, then the range of rotational movement of seat plate 600 is restricted in the direction shown by the arrow 620. Conversely, if only the stop tab 612 is in its locked position, then the range of rotational movement of seat plate 600 is restricted in the direction shown by the arrow 621.

Each adjustable stop tab 610, 612 has an integrally connected handle to allow simple and convenient adjustment of the stop tab by the golfer. Thus, for example, the adjustable stop tab 610 includes a handle portion 614, as shown in FIG. 6. In addition, a tension spring, such as tension spring 616, is provided to retain the adjustable stop tabs in the desired positions. In certain implementations, a screw, rivet or other small vertical extension 619 is provided toward the rear portion of the upper side of the seat plate 600. The vertical extension 619 prevents the seat 28 from tilting backward when the seat 28 is attached to the seat plate 600 and a golfer is seated thereon.

The operation of the training device 20 when used by a golfer is now described. The golfer places the base assembly 22 with the attached base plate 200 upon the ground and drives the spikes 42 into the ground through the eyelet shaped ends 40. The stanchion 24 is adjusted to the desired height and is retained by the pin 116.

Figure 8:
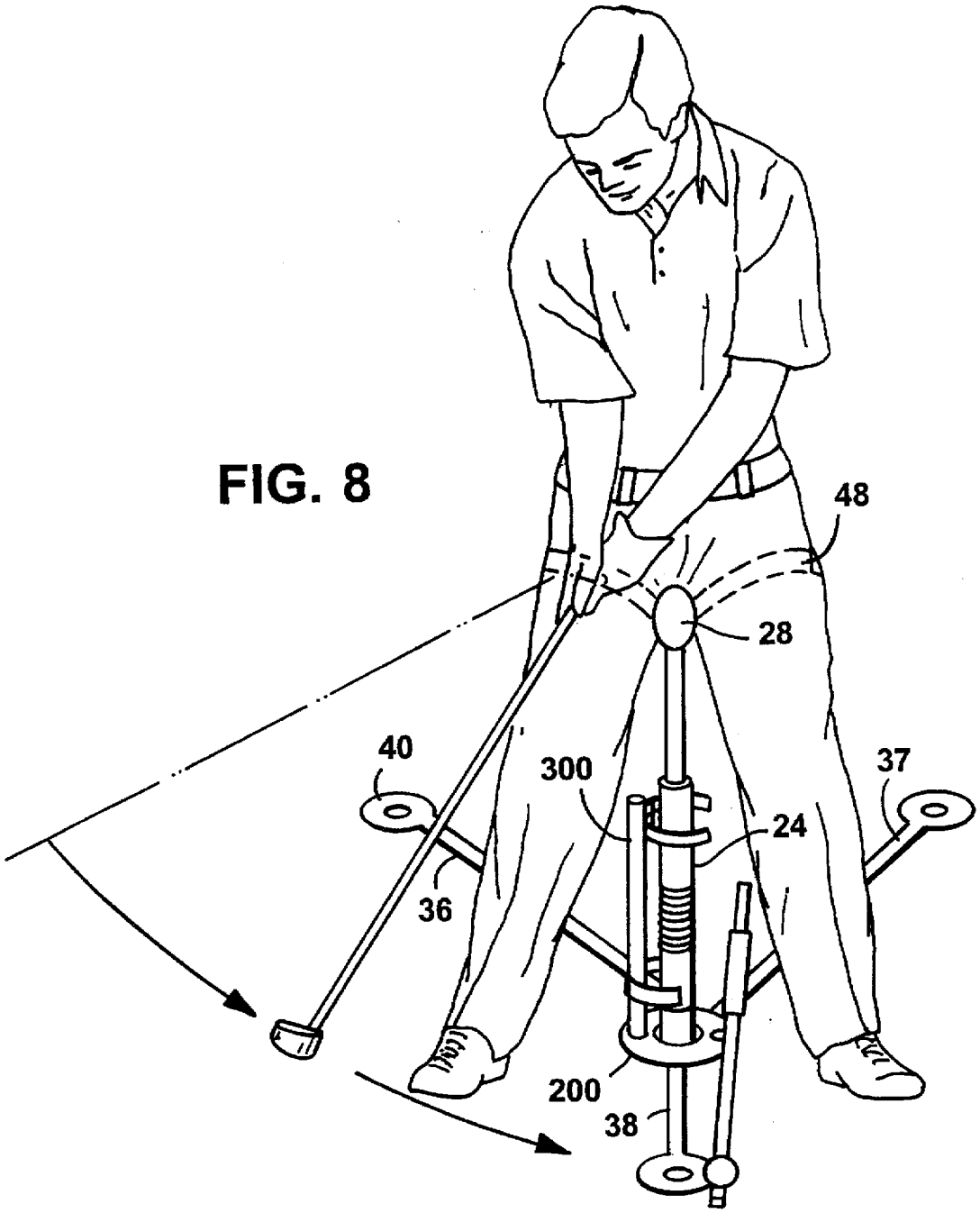
FIG. 8 is a front perspective of the training device of the invention used by a golfer.

The restraining clutch 300 is inserted into one of the bushings 220, 221 of the base plate 200 as shown in FIGS. 3–5. To facilitate the reader's understanding of the choice of bushings 220 or 221 within which the restraining clutch 300 is inserted, the following description of the golfer's position relative to the base assembly 22 is provided. In general, during use of the training device 20, the golfer is seated in the seat 28 with his back toward the feet 36, 37 of the base assembly 22 as depicted in FIG. 8. The golfer's feet are placed on the ground on opposite sides of the short foot 38 of the base assembly 22. The golfer's foot which is further away from the direction in which he or she intends to hit the ball is referred to as the golfer's rear foot.

In general, the restraining clutch 300 is placed in the bushing 220 or 221 which will be closer to the golfer's rear foot when the golfer is seated the seat 28 as described above. Thus, for example, if the golfer is right-handed, the restraining clutch 300 would be placed in the bushing 220 (FIGS. 2 and 5). Conversely, if the golfer is left-handed, the restraining clutch 300 would be placed in the bushing 221. As previously described, when the restraining clutch 300 is properly inserted into one of the bushings 220, 221 of the base plate 200, the V-shaped position fixing element. 306 contacts the upper portion of the outer surface of the collar 44 of the base assembly 22 as shown in FIGS. 4–5.

Next, the golfer adjusts the position of the stop tabs 610, 612. In general, the stop tabs 610, 612 are positioned to restrict the range of rotation of the seat plate 600, and thus the seat 28, opposite the direction of rotation of the swing about the golfer's body. A right-handed golfer would, therefore, position the stop tab 612 in the locked position, whereas a left-handed golfer would position the stop tab 610 in the locked position.

If the training device 20 includes a structure for holding a golf tee and ball in place, the golfer would mount the holding structure side of the base assembly 22. Once the tee and ball are positioned as desired, the golfer sits on the seat 28. The golfer can then practice his or her golf swing.

It should be understood that although the discussion of the various implementations and features of the invention have been discussed in the context of golfing, the training device 20 is suitable for use in other sports as well.

Figure 9:
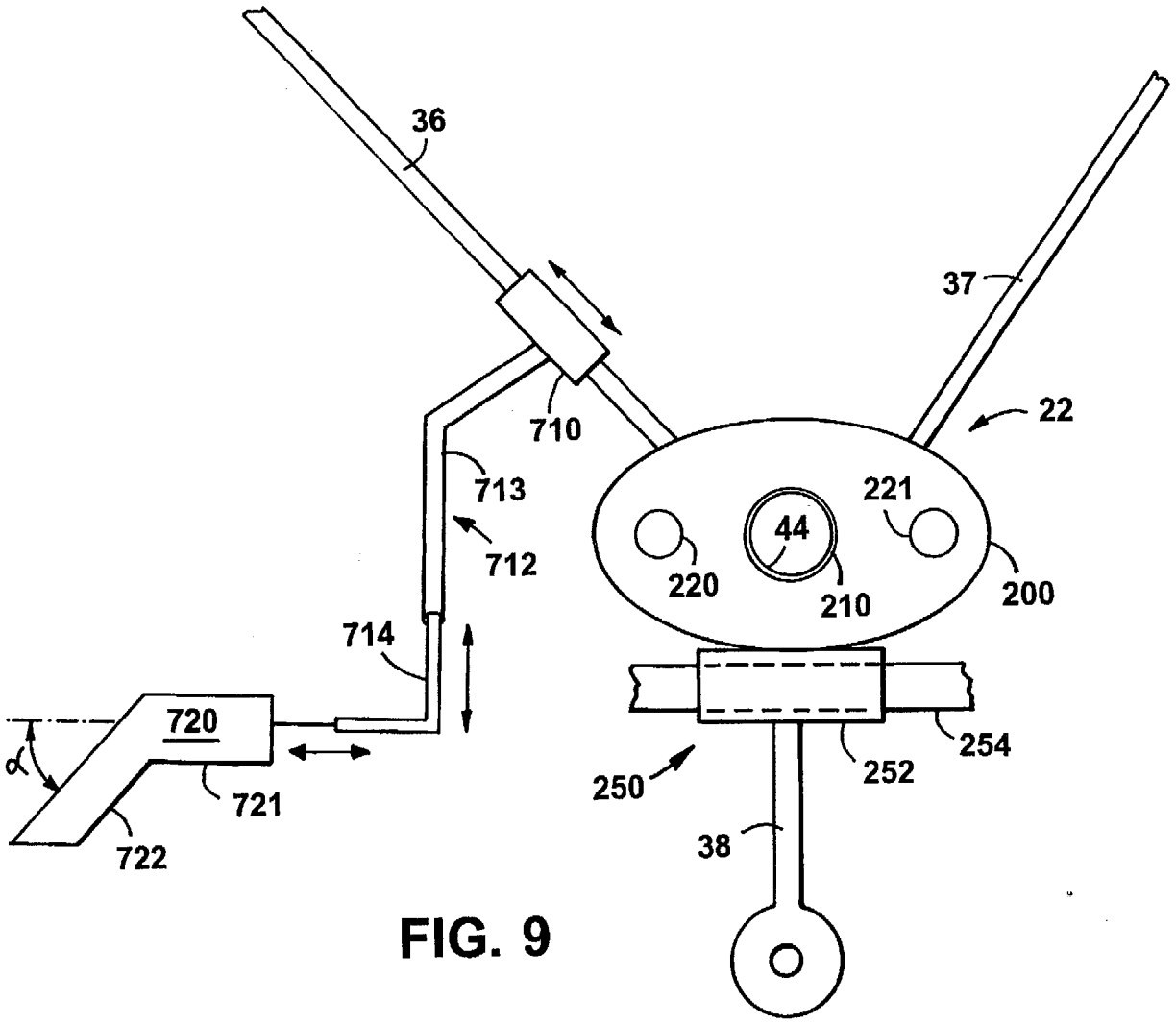
FIG. 9 is a top view of a foot guiding extension for attachment to the training device of the invention.

FIG. 9 illustrates a foot guiding extension for attachment to the base assembly 22 to guide a golfer's stance and which can also be used, for example, to correct or improve a baseball hitter's stride. A detachable bushing 710 is slidably mounted on one of the rearwardly extending feet 36, 37 of the base assembly 22. One end of an s-shaped armature 712 is connected to the bushing 710. The armature 712 includes a tube portion 713 and a shaft portion 714 to allow the length of the armature 712 to be varied in a direction which is parallel to the major axis of the short foot 38. A block 720 is detachably and slidably connected to the other end of the armature 712 to accommodate the width of the hitter's stance or the length and direction of the hitter's stride. The block 720 has two sections, 721, 722. The first section 721 extends in a direction that is generally perpendicular to the axis of the short foot 38. The second section 722 extends away from the first section 721 and away from the axis of the short foot 38. The angle $\alpha$ formed between the second section 722 and the axis along which the block 720 slides is $0°<\alpha\leqq 90°$. Preferably, the angle $\alpha$ is in the vicinity of 45°. In certain implementations, one or both sections 721, 722 of the block 720 are made sufficiently high to prevent the hitter from stepping over the block 720, thereby assisting the hitter to improve his or her stride.

The golfer or other user can slide the bushing 710 along the length of the base assembly foot 36 or 37 to a desired position. Similarly, the length of the shaft portion 714 of the armature 712 can be adjusted as desired. Finally, the user can adjust the position of the block 720 to guide, correct or improve the user's stance or stride. In particular, the foot guiding extension can be adjusted to accommodate the width of the hitter's stance or the direction and length of a hitter's stride.

Figure 10:
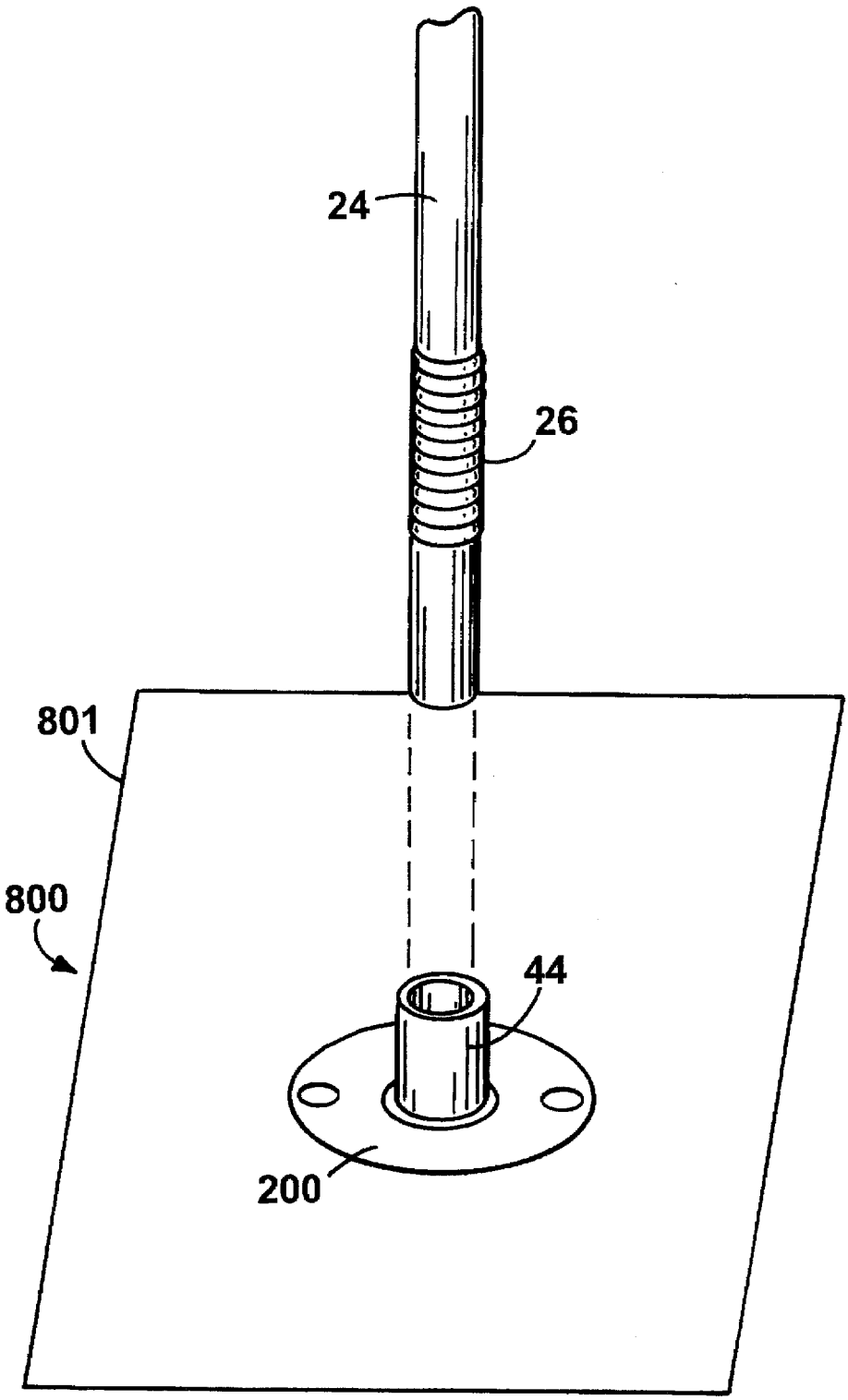
FIG. 10 is a front perspective view of another implementation of a base assembly according to the invention.

FIG. 10 shows another implementation of a base assembly 800 according to the invention. The tri-foot radial configuration of FIG. 1 is replaced by a standing platform 801 to which the base plate 200 and collar 44 are integrally attached and which the hitter stands on when executing a pre-swing stage and a swing stage. The standing platform 801 can be, for example, a rubber carpet mat which can be folded for ease of transportation by the user. During use, the stanchion 25 is inserted into and coupled to the collar 44 as described above. The standing platform should be sufficiently heavy to prevent the assembled device from falling over. In this manner, spikes 42 are not required to hold the base assembly 800 firmly on the ground. It should also be noted that a standing platform can be used in conjunction with the tri-foot radial configuration of FIG. 1. In such an implementation, the tri-foot configuration 34, the base plate 200 and the collar 44 would be attached to the standing platform.

Other implementations within the scope of the claims are contemplated.

What is claimed is:

1. A sport swing training device comprising:

a base assembly;

a height adjustable stanchion comprising a first end and a second end, wherein the first end of the stanchion is attachable to the base assembly, the stanchion further comprising a spring to permit tipping of the stanchion when the stanchion is attached to the base assembly;

an adjustable seat secured to the second end of the stanchion; and a restraining clutch attachable to the base assembly such that, when attached, the restraining clutch limits the range of tipping of the stanchion during a pre-swing stage and a swing stage for hitting a ball.

2. The swing training device of claim 1 wherein the base assembly comprises a base plate having at least one opening for receiving the restraining clutch.

3. The swing training clutch of claim 2 wherein the base assembly further includes a collar to receive the first end of the stanchion, and wherein the restraining clutch comprises a position fixing element which contacts an outer surface of the collar when the restraining clutch is inserted into the opening to secure the restraining clutch in a substantially fixed position relative to the base assembly.

4. The swing training clutch of claim 3 wherein the position fixing element is V-shaped.

5. The swing training device of claim 2 having two openings for receiving the restraining clutch, one opening which is designed for use by right-handed hitters and the other opening which is designed for use by left-handed hitters.

6. The swing training device of claim 1 wherein the restraining clutch comprises a shaft which is substantially parallel to the stanchion when the restraining clutch is attached to the base assembly, and further comprising a ring connected to the shaft to limit the range of tipping of the stanchion during the pre-swing stage and the swing stage.

7. The swing training device of claim 6 wherein the ring is a circular closed ring.

8. The swing training device of claim 6 wherein the ring is an oval-shaped closed ring.

9. The swing training device of claim 6 wherein the ring is a U-shaped ring.

10. The swing training device of claim 6 further comprising a bar intersecting two points of the perimeter of the ring to further limit the range of tipping of the stanchion during the pre-swing stage and the swing stage.

11. The swing training device of claim 1 adapted for use by a golfer to hit a golf ball.

12. A sport swing training device comprising:

a base assembly;

a height adjustable stanchion comprising a first end and a second end, wherein the first end of the stanchion is attachable to the base assembly;

an adjustable seat plate;

an adjustable seat for connection to the second end of the stanchion wherein the seat is secured to the stanchion by the seat plate; and at least one adjustable extension having opened and locked positions for controlling the range of rotational movement of the seat plate.

13. The swing training device of claim 12 further comprising:

a fixed extension which, in conjunction with the adjustable extensions, limits the range of rotational movement of the seat plate when at least one of the adjustable extensions is in the locked position.

14. The swing training device of claim 13 further comprising:

a washer connected between the ends of the stanchion; and wherein the fixed extension is connected to the washer.

15. The swing training device of claim 14 wherein the fixed extension is connected to the underside of the washer.

16. The swing training device of claim 14 wherein the adjustable extensions are rotatably attached to the underside of the seat plate.

17. The swing training device of claim 13 wherein the adjustable extensions are attached to the seat plate.

18. The swing training device of claim 16 wherein the adjustable extensions are rotatably attached to the underside of the seat plate.

19. The swing training device of claim 12 adapted for use by a golfer to hit a golf ball.

20. A sport swing training device comprising:

a base assembly comprising a tri-foot radial configuration having two rearwardly extending feet and a short forwardly extending foot;

a height adjustable stanchion comprising a first end and a second end, wherein the first end of the stanchion is attachable to the base assembly;

an adjustable seat secured to the second end of the stanchion; and a foot guiding extension for attachment to the base assembly to assist a hitter during execution of a pre-swing stage and a swing stage for hitting a ball.

21. The swing training device of claim 20 wherein the foot guiding extension is connected to one of the rearwardly extending feet.

22. The swing training device of claim 21 wherein the stance guiding extension comprises:

a bushing slidably mounted on one of the rearwardly extending feet;

an armature connected to the bushing; and a block slidably connected to the armature to permit adjustment of the position of the block relative to the position of the hitter's feet.

23. The swing training device of claim 22 adapted for use by a golfer.

24. The swing training device of claim 22 adapted for use by a base ball hitter.

25. The swing training device of claim 22 wherein the block comprises a first section that extends in a generally perpendicular direction to the axis of the short foot and a second section that extends away from the first section and away from the axis of the short foot.

26. The swing training device of claim 22 wherein the armature comprises a tube section and a shaft section to allow the length of the armature to be varied.

27. The swing training device of claim 26 wherein the length of the armature can be varied in a direction that is parallel to the axis of the short foot.

28. A method of using a sport swing training device comprising a base assembly, a height adjustable stanchion attached to the base assembly, and comprising a spring to permit tipping of the stanchion when the stanchion is attached to the base assembly, an adjustable seat secured to the stanchion, and a restraining clutch attached to the base assembly, the method comprising:

sitting on the seat; and executing a pre-swing stage and swing stage for hitting a ball wherein the restraining clutch limits the range of tipping of the stanchion during the step of executing.

29. The method of claim 28 wherein the restraining clutch limits the range of tipping of the stanchion in a direction opposite to the direction in which the ball is hit.

30. The method of claim 28 comprising executing a pre-swing stage and swing stage for hitting a golf ball.

31. The method of claim 28 wherein the base assembly comprises a tri-foot radial configuration having two rearwardly extending feet and a short forwardly extending foot, the method further comprising placing one's feet on opposite sides of the short foot of the base assembly.

32. A method of using a sport swing training device comprising a base assembly, a height adjustable stanchion attached to the base assembly, an adjustable seat plate, an adjustable seat secured to the stanchion by the seat plate, and at least one adjustable extension having opened and locked positions for controlling the range of rotational movement of the seat plate, the method comprising:

adjusting at least one of the extensions to be in the locked position;

sitting astride the seat; and executing a pre-swing and a swing stage for hitting a ball wherein the extension in the locked position restricts the range of rotation of the seat during the step of executing.

33. The method of claim 32 wherein the extension in the locked position restricts the rotation of the seat in a direction opposite the direction of rotation of the swing.

34. The method of claim 33 comprising executing a pre-swing stage and swing stage for hitting a golf ball.

35. A method of using a sport swing training device comprising a base assembly comprising a tri-foot radial configuration having two rearwardly extending feet and a short forwardly extending foot, a height adjustable stanchion attachable to the base assembly, an adjustable seat secured to the stanchion, and a stance guiding extension connected to one of the rearwardly extending feet, the method comprising:

adjusting the stance guiding extension to guide a hitter's stance;

executing a pre-swing and a swing stage for hitting a ball.

36. The method of claim 35 wherein the stance guiding extension comprises a bushing slidably mounted on one of the rearwardly extending feet, an armature connected to the bushing, and a block slidably connected to the armature to permit adjustment of the position of the block, the method further comprising adjusting the position of the block to accommodate the width of a hitter's stance.

37. The method of claim 36 comprising executing a pre-swing stage and swing stage for hitting a golf ball.

* * * * *

UNITED STATES PATENT AND TRADEMARK OFFICE

CERTIFICATE OF CORRECTION

PATENT NO. : 5,665,005

DATED : September 9, 1997

INVENTOR(S) : Gregory A. Ritchie

It is certified that error appears in the above-identified patent and that said Letters Patent is hereby corrected as shown below:

Col. 6, ln. 65, after "claim" change "14" to --13--.

Col. 6, ln. 66, delete the words "rotatably" and "underside".

Col. 6, ln. 67, before "seat plate" delete the words "of the".

Col. 7, ln. 1, after "claim" change "13" to --16--.

Col. 7, ln. 2, insert --rotatably-- before "attached" and insert --underside of the-- before "seat plate".

Col. 7, ln. 3, cancel "18. The swing training" to and including "seat plate." in line 5 and insert the following claim:

--18. The swing training device of claims 12 adapted for use by a golfer to hit a golf ball.--

UNITED STATES PATENT AND TRADEMARK OFFICE

CERTIFICATE OF CORRECTION

PATENT NO. : 5,665,005

DATED : September 9, 1997

INVENTOR(S) : Gregory A. Ritchie

It is certified that error appears in the above-identified patent and that said Letters Patent is hereby corrected as shown below:

Col. 7, ln. 6, cancel "19. The swing training" to and including "golf ball." in line 7 and insert the following claim:

--19. The swing training device of claim 14 wherein the adjustable extensions are rotatably attached to the underside of the seat plate.--

Signed and Sealed this

Fourteenth Day of April, 1998

Bruce Lehman

*Attest:*

BRUCE LEHMAN

*Attesting Officer*

*Commissioner of Patents and Trademarks*